US005190023A

United States Patent [19]

Sacco

[11] Patent Number: 5,190,023

[45] Date of Patent: Mar. 2, 1993

[54] GRIP REST

[76] Inventor: Edward Sacco, 2178 County Rte. 4, Central Square, N.Y. 13036

[21] Appl. No.: 733,692

[22] Filed: Jul. 22, 1991

[51] Int. Cl.[5] ..... F41A 9/00

[52] U.S. Cl. ..... 124/44.5; 124/24.1

[58] Field of Search ..... 124/23.1, 900, 24.1, 124/25, 41.1, 44.5; 248/316.1

[56] References Cited

U.S. PATENT DOCUMENTS

| | | | |
|---|---|---|---|
| 3,865,096 | 2/1975 | Troncoso | 124/24.1 |
| 3,935,854 | 2/1976 | Troncoso | 124/24.1 |
| 4,236,497 | 12/1980 | Troncoso | 124/24.1 |
| 4,838,237 | 6/1989 | Cliburn | 124/41.1 |
| 4,949,699 | 8/1990 | Gerber | 124/44.5 |
| 5,009,215 | 4/1991 | Ludwig | 124/24.1 X |
| 5,031,601 | 7/1991 | Gunter | 124/44.5 |
| 5,070,855 | 12/1991 | Troncoso | 124/24.1 X |
| 5,095,884 | 3/1992 | Mertens | 124/44.5 |
| 5,103,797 | 4/1992 | Newbold | 124/24.1 X |

FOREIGN PATENT DOCUMENTS

| | | | |
|---|---|---|---|
| 2597968 | 10/1987 | France | 124/24.1 |

*Primary Examiner*—J. Franklin Foss

*Attorney, Agent, or Firm*—Katherine McGuire

[57] ABSTRACT

An arrow grip for mounting upon the arrow ledge of the handle of a bow comprises elongated gripping members configured and positioned to frictionally engage opposite side surfaces of the shaft of an arrow to hold it in proper position prior to firing of the arrow. The bow may be held at any angle without the nocked arrow falling therefrom. When fired, the shaft of the arrow travels freely through the gripping members with no affect to the normal trajectory of the fired arrow. Spring means are provided to accomodate downward forces upon the gripping members greater than the biasing force of the spring means.

8 Claims, 1 Drawing Sheet

GRIP REST

BACKGROUND OF THE INVENTION

This invention relates to arrow grips and, more particularly, to an improved grip rest for attachment to the arrow rest of a bow which is configured to releasably hold the shaft of a nocked arrow until fired.

Modern day anchery bows have much more power than the original long bows and recurve bows which have been in existence for many years. With the advent of the compound bow, archers are able to pull up to a ninety pound or more draw of the bow string versus thirty-five to forty pound draw with a conventional long bow. Accordingly, the arrows fired with a compound bow travel at a much higher velocity and reach further distances than arrows fired with the long or recurve bows. To increase the speed and distance of an arrow, archers have been known to equip their bows with "over-draws" which permit a shorter, stiffer arrow to be fired from a conventional compound bow than would be possible without the over-draw feature.

The over-draw is simply a horizontal, rearward extension (toward the bow string) of the arrow-rest portion of the bow handle which forms a ledge on which the forward shaft of the arrow usually rests during the draw and firing of the arrow. This rearward extension of the arrow rest permits the arrow to be drawn back a further distance without its distal, pointed end falling therefrom. While permitting draws of larger distance to increase the power and, hence, velocity at which the arrow is fired (due to increased tension in the bow string), the over-draw feature creates a potential hazard to the archer's hand gripping the handle since the tip of the arrow is necessarily drawn behind the handle-gripping hand and might strike and injure it when fired.

Besides equipping their bows with over-draws, archers have also been likened to grip rests which attach adjacent the arrow rest of the bow handle. The desired feature expressed by many of the archers is the capability of the grip rest to engage the shaft of the nocked arrow to prevent it falling therefrom prior to firing. It is the intent that the archer may have an arrow nocked and ready for firing yet be able to relax the arm gripping the bow handle while searching for prey without having the arrow fall therefrom.

Various arrow rests have therefore been developed in attempts to hold the distal end of the arrow in proper position before and during firing without interfering with the normal trajectory of the fired arrow. In an grip rest for mounting upon a bow handle in a position rearwardly of the handle which also appears to accomodate arrow over-draw, U.S. Pat. No. 4,838,237 issued to Cliburn on Jun. 13, 1989 includes independently pivotable fingers which support the shaft of the arrow and which may be pivotally deflected by uneven forces applied thereto as the arrow is fired. The invention of the '237 patent, while sufficient at providing a seat for the distal portion of the shaft of the arrow, fails in not providing means to prevent the arrow from falling off the rest should the archer tilt or invert the bow in any way prior to firing the arrow. This feature is especially desirable for bow hunters who like to keep an arrow nocked in ready position while looking for game so that when game is sighted, the archer need only raise his bow, pull the bow string, aim and fire.

U.S. Pat. No. 4,890,596 issued to Barlow on Jan. 2, 1990 discloses an arrow rest having a pair of coil springs positioned to engage and support the arrow shaft. This arrow rest also appears to lack the above mentioned feature which would prevent the arrow from falling should the archer relax the arm gripping the bow.

U.S. Pat. Nos. 2,483,928, 3,158,145 and 4,949,699 reveal arrow rests configured to grasp the arrow shaft to prevent the arrow from falling therefrom; however, each require manual manipulation of the device to release its grip upon the arrow prior to firing. Once released, the arrow merely rests upon the device until fired, providing the chance for slippage or falling therefrom should the bow be tilted prior to firing. The devices of the '928, '145 and '699 patents also do not accomodate an over-draw arrow as previously described.

It is therefore a principal object of the present invention to provide a device which serves the purposes of an arrow guide, rest and grip, all in one.

It is another object of the invention to provide an arrow grip which is effective at keeping the arrow in the nocked position ready for firing no matter at what angle the bow is carried.

It is a further object of the invention to provide an arrow rest which is effective at maintaining an arrow of less than conventional length in proper firing position during execution of an overdraw of the arrow.

It is still another object of the invention to provide an arrow grip rest which does not interfere with the normal trajectory of the arrow upon firing thereof.

Other objects will in part be obvious and in part appear hereinafter.

SUMMARY OF THE INVENTION

In accordance with the foregoing objects, the invention comprises a device for gripping and guiding an arrow before and during firing thereof. An elongated, rigid plate mounts upon the horizontal arrow ledge of a bow handle. The plate extends horizontally rearwardly therefrom towards the bow string, bending slightly downwardly at the free end thereof. A pair of rigid legs are pivotally mounted to the downwardly sloping portion of the plate and extend upwardly toward the forward end of the plate. The free ends of the legs include elongated, arrow gripping members which are configured and positioned to frictionally engage opposite side surfaces of the shaft of an arrow when placed therebetween. Spring means are provided such that the arrow gripping members are biased in a position directing the arrow along a normal firing trajectory; however, any forces applied by the arrow to the gripping members during firing which are greater than the biasing force cause pivoting in a downward direction of the legs and gripping members to prevent interfering with the normal trajectory of the arrow.

DETAILED DESCRIPTION

Figure 1:
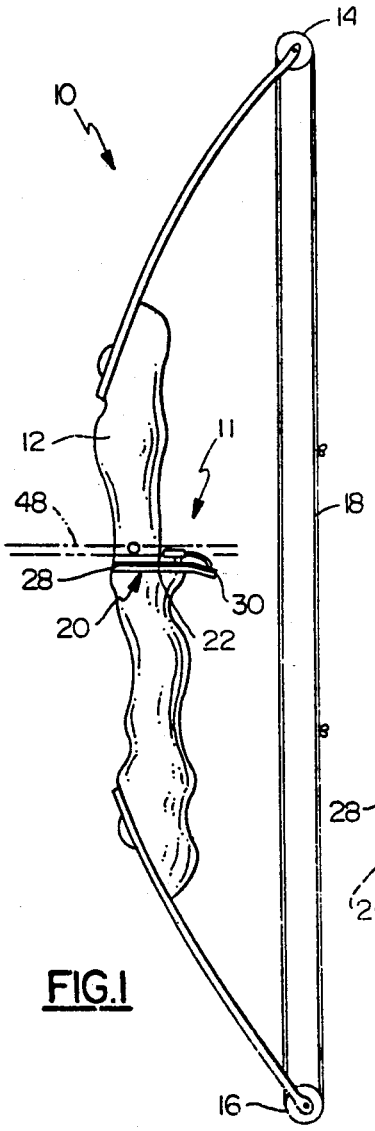
FIG. 1 is a simplified, side, elevational view of a compound bow showing the invention mounted upon the arrow ledge of the handle with a segment of an arrow shaft shown in phantom attached thereto.

Referring now to the drawings, there is seen in FIG. 1 a compound bow 10 having a handle 12, top and bottom pulleys 14 and 16, respectively, and bow string 18 to which the nock of an arrow is releasably attached. The handle 12 of bow structures of today include an arrow ledge 20 defining a "window" with the adjacent vertical wall of handle 12 and through which the arrow is aimed and fired. Without an arrow grip rest such as the present invention provides, an archer would nock the arrow and rest the distal portion of the arrow shaft adjacent the tip on the ledge 20, holding it thereon with the forefinger of the hand grasping the handle until the arrow is fired. The present invention provides an arrow grip rest which engages the shaft of the arrow such that the shaft extends above the arrow ledge 20.

Figure 3:
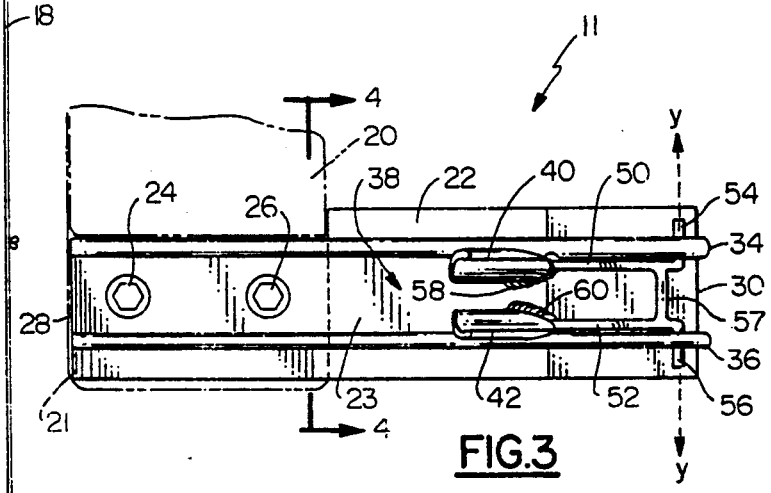
FIG. 3 is a top plan view of the arrow grip seen in FIG. 2.
Figure 2:
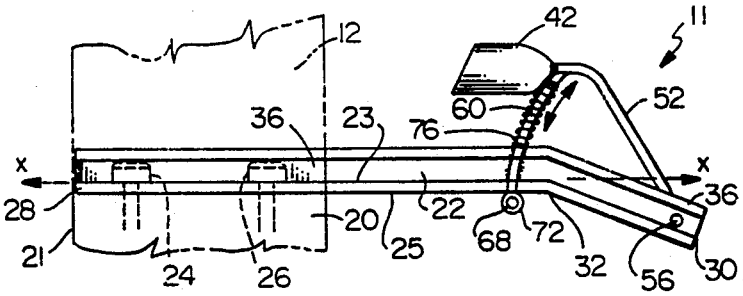
FIG. 2 is a side, elevational view of the arrow grip rest invention shown mounted to the arrow ledge of a handle shown broken away and in phantom.

In particular, the arrow grip rest, designated generally by the reference numeral 11, includes an elongated, rigid mounting plate 22 which is anchored flatly on top of ledge 20 via longitudinally spaced bolts 24 and 26 which extend into ledge 20 to secure plate 22 thereto. Plate 22 includes a front edge 28 which, when mounted to ledge 20, lies normally flush with the front edge 21 of ledge 20 as seen in FIGS. 2 and 3, plate 22 extending rearwardly therefrom terminating in a back edge 30. As seen clearly in FIG. 2, a rearward section of plate 22 bends at point 32 to slope downwardly at a somewhat less than 45° angle to the longitudinal axis x—x of plate 22. Plate 22 also includes a pair of spaced, parallel ribs 34 and 36 traversing the top surface 23 of plate 22 from front edge 28 to rear edge 30 thereby forming a longitudinal channel 38 therebetween. A rectangular segment of plate 22 along the edge of plate 22 lying adjacent handle 12 and adjacent front edge 28 is cut out such that rib 34 abuts the verticle wall of handle 12 adjacent ledge 20 as seen in FIG. 3.

The elements of arrow grip rest 11 frictionally engaging and supporting the shaft of an arrow will now be described. A pair of elongated arrow gripping members 40 and 42 are shaped and configured as seen best in FIG. 5 to frictionally engage opposite side edges of the shaft of an arrow therebetween. Each member 40 and 42 is elongated and curves to form inner, concave surfaces 44 and 46, respectively, to conform to opposite side surfaces of the arrow shaft 48 when positioned therebetween as seen in FIG. 4.

Members 40 and 42 are mounted upon the ends of rigid legs 50 and 52, respectively, which bend downwardly to pivotally attach to respective plate ribs 34 and 36 adjacent rear edge 30. It is seen in FIG. 3 that legs 50 and 52 include laterally projecting end segments 54 and 56, respectively, which extend into respective, lateral holes in ribs 34 and 36 such that legs 50 and 52, including members 40 and 42, may pivot about segments 54 and 56 axis y—y of rotation. A rigid support bar 57, as seen in FIG. 3, extends between legs 50 and 52 to secure legs 50 and 52 including gripping members 40 and 42 in the properly spaced position to receive and frictionally grasp arrow shaft 48.

A second pair of legs 58 and 60 attach to legs 50 and 52, respectively, at first ends thereof adjacent members 40 and 42. Legs 58 and 60 extend downwardly therefrom, bending slightly toward each other as seen in FIG. 4, and pass through laterally spaced holes 62 and 64 extending through plate 22 between ribs 34 and 36. Legs 58 and 60 include laterally projecting segments 66 and 68, respectively, at second ends thereof which act as a stop against the bottom surface 25 of plate 22, segments 66 and 68 including rubber coverings 70 and 72, respectively, to provide a cushion between segments 66 and 68 and plate 22. Legs 58 and 60 are seen to include helical springs 74 and 76, respectively, positioned about legs 58 and 60 and extending from legs 50 and 52 to plate 22. Springs 74 and 76 effectively bias legs 58 and 60 in the fully raised position in the direction away from plate 22 whereby rubber coverings 70 and 72 abut the bottom surface 25 of plate 22 as seen in FIGS. 2 and 4. In this respect, members 40 and 42 may move downwardly in accordance with the directional arrows in FIG. 2 when a force is exerted thereupon greater than the biasing force of springs 58 and 60. This may occur, for example, as the feathers of the arrow pass thereover as the arrow is fired.

Figure 4:
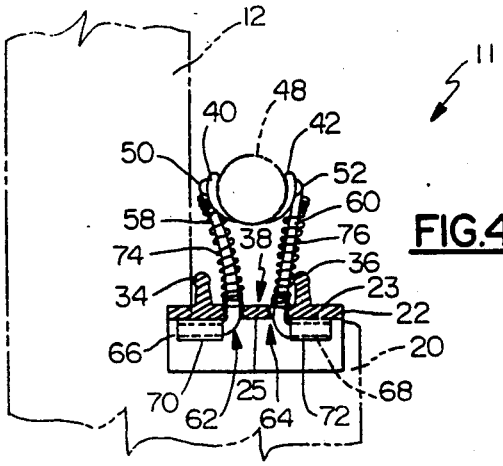
FIG. 4 is a cross-sectional, front, elevational view of the arrow grip rest as taken generally along the line 4—4 in FIG. 3.
Figure 5:
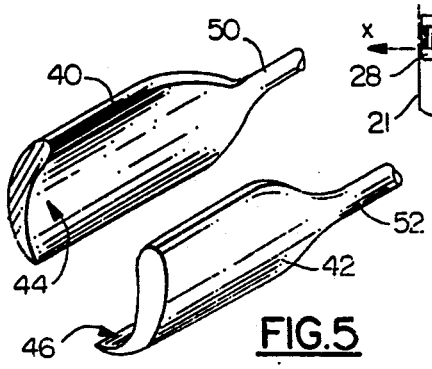
FIG. 5 is a fragmentary, perspective view of the pair of elongated, arrow gripping members of the invention.

To position an arrow upon arrow grip rest 11, an arrow is nocked in the usual manner to bow string 18 (not shown) and the arrow shaft 48 is positioned between gripping members 40 and 42 as seen in FIG. 4. The spacing between members 40 and 42 in relation to the diameter of the arrow shaft 48 are such that members 40 and 42 frictionally engage shaft 48 when positioned therebetween. The smoothly contoured inner surfaces 44 and 46 of members 40 and 42 permit shaft 48 to freely slide in a back and forth direction along the line of fire of the arrow. The frictional engagement between members 40 and 42 and arrow shaft 48 prevent shaft 48, and thus the arrow, from disengaging therefrom until the arrow is either fired or shaft 48 is manually pulled from between members 40 and 42. Once an archer nocks his arrow and positions the shaft 48 of the arrow between members 40 and 42, he or she may thereafter tilt the bow in any manner, even totally upside down, without arrow shaft 48 disengaging from members 40 and 42. The archer may therefore relax the arm grasping handle 12 while searching for the prey. Once sighted, the archer simply aims and pulls the bow string to fire the arrow. When fired, the shaft 48 of the arrow travels along the linear path defined between and along members 40 and 42.

The improvements of the present invention over the prior art may thus be appreciated in that the archer may nock the arrow and set the shaft in the arrow grip without fear of having it fall therefrom should s/he relax his/her arm holding the bow as would occur with many of the arrow grips of the prior art. Furthermore, the gripping members 40 and 42, while effective at frictionally engaging shaft 48 until the arrow is fired, are configured to provide no affect on the normal trajectory of the arrow fired therethrough. If a downward force is applied against members 40 and 42 by either the arrow or its feathers as the arrow is fired, legs 50 and 52 may move downwardly through holes 62 and 64 in plate 22 and then return to the position seen in FIGS. 2 and 4 due to the biasing force of springs 58 and 60. If it is desired to adjust the angle at which a nocked arrow is positioned in the arrow grip, bolts 24 and 26 may be alternately tightened and loosened which respectively adjusts the angle plate 22 makes with handle 12.

While the invention has been described with particular reference to the preferred embodiment thereof, it will be appreciated to those skilled in the art that modification of the invention may be made without departing from the full spirit and scope thereof as is set forth in the claims which follow.

What is claimed is:

1. An arrow grip rest comprising:

a) an elongated support plate having a central, longitudinal axis and including front and rear edges with first and second, opposite side edges, all defining top and bottom surfaces extending therebetween;

b) means mounting said plate to the arrow ledge of a bow handle;

c) first and second rigid legs pivotally attached at first ends thereof to said support plate adjacent said rear edge about an axis perpendicular to said longitudinal axis of said support plate, said first and second legs extending upwardly from said plate top surface substantially parallel to each other and terminating at second ends thereof, said legs being movable about said pivotal attachment between fully raised and fully lowered positions;

d) first and second, elongated gripping members fixedly mounted to said second ends of said first and second legs and extending substantially parallel to said longitudinal axis, said gripping members having concave surfaces facing each other and positioned a predetermined distance from each other whereby the shaft of an arrow may be placed therebetween with said concave surfaces frictionally engaging opposite side surfaces of said shaft and positioning said shaft along an axis substantially parallel to said longitudinal axis of said plate; and e) spring means resiliently biasing said first and second legs in said fully raised position.

2. The invention according to claim 1 wherein said spring means comprises third and fourth rigid legs attached to said second ends of said first and second legs at first ends thereof, said third and fourth legs extending therefrom towards said plate and extending through laterally spaced holes in said plate and terminating in second, free ends including stop means engaging said bottom surface of said plate when said first and second legs are in said fully raised position and further including first and second helical springs positioned around said third and fourth legs, respectively, and extending from said first ends of said third and fourth legs to said top surface of said plate adjacent said holes.

3. The invention according to claim 2 wherein said stop means comprises said second, free ends bending in a direction away from each other, one of said free ends bending toward said first side edges and the other of said free ends bending toward said second side edge whereby said free ends lie in abutting contact with said plate bottom surface when said first and second legs are in said fully raised position.

4. The invention according to claim 3 wherein each of said free ends include a rubber covering.

5. The invention according to claim 1 wherein a rear segment of said plate including said rear edge bends downwardly about an axis perpendicular to said longitudinal axis.

6. The invention according to claim 5 wherein said plate includes a pair of ribs traversing said plate from said front edge to said rear edge parallel and adjacent to said first and second side edges, respectively, said ribs each including a hole laterally extending therethrough adjacent said rear edge of said plate, said holes aligned along an axis substantially perpendicular to said plate longitudinal axis, whereby each of said first ends of said first and second legs bend and extend through a respective one of said holes.

7. The invention according to claim 6 and further including a stabilizing bar mounted to and extending between said first and second legs adjacent said first ends thereof.

8. The invention according to claim 1 wherein said mounting means comprises a pair of longitudinally spaced bolts extending through said plate and into said ledge.

* * * * *